US009068407B2

(12) United States Patent
Radford et al.

(10) Patent No.: US 9,068,407 B2
(45) Date of Patent: Jun. 30, 2015

(54) DRILLING ASSEMBLIES INCLUDING EXPANDABLE REAMERS AND EXPANDABLE STABILIZERS, AND RELATED METHODS

(71) Applicant: Baker Hughes Incorporated, Houston, TX (US)

(72) Inventors: Steven R. Radford, The Woodlands, TX (US); L. Allen Sinor, Conroe, TX (US); Anders K. Nesheim, Bru (NO)

(73) Assignee: Baker Hughes Incorporated, Houston, TX (US)

( * ) Notice: Subject to any disclaimer, the term of this patent is extended or adjusted under 35 U.S.C. 154(b) by 201 days.

(21) Appl. No.: 13/841,422

(22) Filed: Mar. 15, 2013

(65) Prior Publication Data

US 2013/0292175 A1 Nov. 7, 2013

Related U.S. Application Data

(60) Provisional application No. 61/642,026, filed on May 3, 2012.

(51) Int. Cl.
*E21B 10/32* (2006.01)

(52) U.S. Cl.
CPC ..... *E21B 10/32* (2013.01); *Y10T 29/49826* (2015.01)

(58) Field of Classification Search
CPC ..... E21B 10/32; E21B 41/0085
See application file for complete search history.

(56) References Cited

U.S. PATENT DOCUMENTS

| | | | |
|---|---|---|---|
| 1,678,075 | A | 7/1928 | Phipps |
| 2,069,482 | A | 2/1937 | Seay |
| 2,177,721 | A | 10/1939 | Johnson et al. |
| 2,344,598 | A | 3/1944 | Church |
| 2,754,089 | A | 7/1956 | Kammerer, Jr. |
| 2,758,819 | A | 8/1956 | Kammerer, Jr. |
| 2,834,578 | A | 5/1958 | Carr |
| 2,882,019 | A | 4/1959 | Carr et al. |

(Continued)

FOREIGN PATENT DOCUMENTS

| | | | |
|---|---|---|---|
| EP | 246789 | A2 | 11/1987 |
| EP | 1036913 | A1 | 9/2000 |

(Continued)

OTHER PUBLICATIONS

International Search Report for International Application No. PCT/US2013/039480 dated Sep. 27, 2013, 5 pages.

(Continued)

*Primary Examiner* — William P Neuder
(74) *Attorney, Agent, or Firm* — TraskBritt

(57) ABSTRACT

A drilling assembly for drilling a subterranean wellbore includes an expandable reamer and an expandable stabilizer. The expandable reamer and the expandable stabilizer each have a tubular body with a longitudinal axis and a drilling fluid flow path extending therethrough. A plurality of blades is carried by the reamer and a plurality of bearing pads is carried by the stabilizer. The blades and bearing pads are outwardly movable from a retracted position to an extended position with respect to the longitudinal axes of the reamer and stabilizer, respectively. The reamer and stabilizer each include an actuation device for moving the blades and bearing pads, respectively, from the retracted position to the extended position.

20 Claims, 8 Drawing Sheets

(56) References Cited

U.S. PATENT DOCUMENTS

| | | | |
|---|---|---|---|
| 3,105,562 | A | 10/1963 | Stone et al. |
| 3,123,162 | A | 3/1964 | Rowley |
| 3,126,065 | A | 3/1964 | Chadderdon |
| 3,211,232 | A | 10/1965 | Grimmer. |
| 3,224,507 | A | 12/1965 | Cordary, Jr. |
| 3,425,500 | A | 2/1969 | Fuchs |
| 3,433,313 | A | 3/1969 | Brown |
| 3,556,233 | A | 1/1971 | Gilreath |
| 4,403,659 | A | 9/1983 | Upchurch |
| 4,458,761 | A | 7/1984 | Van Vreeswyk |
| 4,545,441 | A | 10/1985 | Williamson |
| 4,589,504 | A | 5/1986 | Simpson |
| 4,660,657 | A | 4/1987 | Furse et al. |
| 4,690,229 | A | 9/1987 | Raney |
| 4,693,328 | A | 9/1987 | Furse et al. |
| 4,842,083 | A | 6/1989 | Raney |
| 4,848,490 | A | 7/1989 | Anderson |
| 4,854,403 | A | 8/1989 | Ostertag et al. |
| 4,884,477 | A | 12/1989 | Smith et al. |
| 4,889,197 | A | 12/1989 | Boe |
| 5,139,098 | A | 8/1992 | Blake |
| 5,211,241 | A | 5/1993 | Mashaw, Jr. et al. |
| 5,224,558 | A | 7/1993 | Lee |
| 5,265,684 | A | 11/1993 | Rosenhauch |
| 5,293,945 | A | 3/1994 | Rosenhauch et al. |
| 5,305,833 | A | 4/1994 | Collins |
| 5,318,131 | A | 6/1994 | Baker |
| 5,318,137 | A | 6/1994 | Johnson et al. |
| 5,318,138 | A | 6/1994 | Dewey et al. |
| 5,332,048 | A | 7/1994 | Underwood et al. |
| 5,343,963 | A | 9/1994 | Bouldin et al. |
| 5,361,859 | A | 11/1994 | Tibbitts |
| 5,368,114 | A | 11/1994 | Tandberg et al. |
| 5,375,662 | A | 12/1994 | Echols, III et al. |
| 5,425,423 | A | 6/1995 | Dobson et al. |
| 5,437,308 | A | 8/1995 | Morin et al. |
| 5,553,678 | A | 9/1996 | Barr et al. |
| 5,560,440 | A | 10/1996 | Tibbitts et al. |
| 5,740,864 | A | 4/1998 | de Hoedt et al. |
| 5,788,000 | A | 8/1998 | Maury et al. |
| 5,823,254 | A | 10/1998 | Dobson et al. |
| 5,887,655 | A | 3/1999 | Haugen et al. |
| 6,039,131 | A | 3/2000 | Beaton |
| 6,059,051 | A | 5/2000 | Jewkes et al. |
| 6,070,677 | A | 6/2000 | Johnston |
| 6,109,354 | A | 8/2000 | Ringgenberg et al. |
| 6,116,336 | A | 9/2000 | Adkins et al. |
| 6,131,675 | A | 10/2000 | Anderson |
| 6,189,631 | B1 | 2/2001 | Sheshtawy |
| 6,213,226 | B1 | 4/2001 | Eppink et al. |
| 6,220,375 | B1 | 4/2001 | Butcher et al. |
| 6,227,312 | B1 | 5/2001 | Eppink et al. |
| 6,289,999 | B1 | 9/2001 | Dewey et al. |
| 6,325,151 | B1 | 12/2001 | Vincent et al. |
| 6,378,632 | B1 | 4/2002 | Dewey |
| 6,488,104 | B1 | 12/2002 | Eppink et al. |
| 6,494,272 | B1 | 12/2002 | Eppink et al. |
| 6,615,933 | B1 | 9/2003 | Eddison |
| 6,668,936 | B2 | 12/2003 | Williamson, Jr. et al. |
| 6,668,949 | B1 | 12/2003 | Rives |
| 6,708,785 | B1 | 3/2004 | Russell et al. |
| 6,732,817 | B2 | 5/2004 | Dewey et al. |
| 7,036,611 | B2 | 5/2006 | Radford et al. |
| 7,048,078 | B2 | 5/2006 | Dewey et al. |
| 7,314,099 | B2 | 1/2008 | Dewey et al. |
| 7,493,971 | B2 | 2/2009 | Nevlud et al. |
| 7,513,318 | B2 | 4/2009 | Underwood et al. |
| 7,549,485 | B2 | 6/2009 | Radford et al. |
| 7,681,666 | B2 | 3/2010 | Radford et al. |
| 7,882,905 | B2 * | 2/2011 | Radford et al. ..... 175/291 |
| 7,900,717 | B2 | 3/2011 | Radford et al. |
| 8,020,635 | B2 | 9/2011 | Radford |
| 8,028,767 | B2 | 10/2011 | Radford et al. |
| 8,205,689 | B2 * | 6/2012 | Radford ..... 175/270 |
| 8,235,144 | B2 | 8/2012 | Rasheed |
| 8,365,843 | B2 | 2/2013 | Hall et al. |
| 2002/0070052 | A1 | 6/2002 | Armell |
| 2003/0029644 | A1 | 2/2003 | Hoffmaster et al. |
| 2006/0113113 | A1 * | 6/2006 | Underwood et al. ..... 175/61 |
| 2009/0242275 | A1 * | 10/2009 | Radford et al. ..... 175/57 |
| 2009/0294178 | A1 | 12/2009 | Radford |
| 2010/0139981 | A1 | 6/2010 | Meister et al. |
| 2011/0005836 | A1 | 1/2011 | Radford et al. |
| 2011/0127044 | A1 | 6/2011 | Radford et al. |
| 2011/0284233 | A1 | 11/2011 | Wu et al. |

FOREIGN PATENT DOCUMENTS

| | | | |
|---|---|---|---|
| EP | 1044314 | A1 | 10/2000 |
| GB | 2328964 | A | 3/1999 |
| GB | 2344122 | A | 5/2000 |
| GB | 2344607 | A | 6/2000 |
| GB | 2344122 | B | 4/2003 |
| GB | 2460096 | A | 11/2009 |
| WO | 0031371 | A1 | 6/2000 |
| WO | 2009135116 | A2 | 11/2009 |

OTHER PUBLICATIONS

International Written Opinion for International Application No. PCT/US2013/039480 dated Sep. 27, 2013, 10 pages.

International Preliminary Report on Patentability for International Application No. PCT/US2013/039480 dated Nov. 4, 2014, 11 pages.

* cited by examiner

DRILLING ASSEMBLIES INCLUDING EXPANDABLE REAMERS AND EXPANDABLE STABILIZERS, AND RELATED METHODS

CROSS-REFERENCE TO RELATED APPLICATION

This application claims the benefit of U.S. Provisional Patent Application Ser. No. 61/642,026, filed May 3, 2012, titled "Drilling Assemblies Including Expandable Reamers and Expandable Stabilizers, and Related Methods," the disclosure of which is incorporated herein in its entirety by this reference.

TECHNICAL FIELD

Embodiments of the present disclosure relate generally to drilling assemblies for use in drilling subterranean boreholes and, more particularly, to drilling assemblies that include both an actuatable expandable reamer and an actuatable expandable stabilizer, and to methods of making and using such drilling assemblies.

BACKGROUND

Expandable reamers are typically employed for enlarging subterranean boreholes. In drilling oil, gas, and geothermal wells, casing is installed and cemented to prevent the wellbore walls from caving into the subterranean borehole while also providing requisite shoring for subsequent drilling operation to achieve greater depths. Casing is also conventionally installed to mutually isolate different formations, to prevent crossflow of formation fluids, and to enable control of formation fluids and pressure as the borehole is being drilled. To increase the depth of a previously drilled borehole, new and smaller diameter casing, or "liner," is disposed within and extended below the previous casing. However, while adding additional casing allows a borehole to reach greater depths, the additional, smaller casing has the disadvantage of narrowing the borehole. Narrowing the borehole restricts the diameter of any subsequent sections of the well because the drill bit and any further casing must pass through the smaller casing. As reductions in the borehole diameter are undesirable because they limit the production flow rate of oil and gas through the borehole, it is often desirable to enlarge a subterranean borehole to provide a larger borehole diameter beyond previously installed casing to enable better production flow rates of hydrocarbons through the borehole.

Various approaches to expand a borehole may include expandable stabilizer blocks or bearing pads used in an expandable stabilizer located longitudinally above an expandable reamer to increase stability and reduce dysfunctional loads, i.e., lateral vibrational loads, thereupon while reaming. In most instances, fixed stabilizer pads or blocks, being sized and configured for a corresponding hole diameter cut by a pilot bit or drill bit, are located in a drill string between the bit and the expandable reamer. The stabilizer bearing pads or blocks help to control stability, particularly when conducting a so called "down drill" operation, e.g., drilling in the down-hole direction. Also, stability is further improved by providing a point of control above an expandable reamer to decrease the flexibility of the drill string about the expandable reamer.

BRIEF SUMMARY

This summary is provided to introduce a selection of concepts in a simplified form. These concepts are described in further detail in the detailed description of example embodiments of the disclosure below. This summary is not intended to identify key features or essential features of the claimed subject matter, nor is it intended to be used to limit the scope of the claimed subject matter.

In some embodiments, the present disclosure includes a drilling assembly for drilling a subterranean wellbore. The drilling assembly includes an expandable reamer having a first tubular body with a first longitudinal axis and a first drilling fluid flow path extending therethrough. A plurality of blades is carried by the first tubular body, and a cutting structure is carried by at least one blade of the plurality of blades wherein the at least one blade is outwardly movable from a refracted position to an extended position with respect to the first longitudinal axis. The drilling assembly also includes an expandable stabilizer axially located a distance of about 25 feet or less above the expandable reamer in the drilling assembly, the expandable stabilizer has a second tubular body with a second longitudinal axis and a second drilling fluid flow path extending therethrough. A plurality of bearing pads is carried by the second tubular body, wherein at least one bearing pad of the plurality of bearing pads is outwardly movable from a refracted position to an extended position with respect to the second longitudinal axis.

In additional embodiments, the present disclosure includes a drilling assembly for drilling a subterranean wellbore, including an expandable reamer having a first tubular body with a first longitudinal axis and a first drilling fluid flow path extending therethrough. A plurality of blades is carried by the first tubular body, and a cutting structure is carried by at least one blade of the plurality of blades, wherein the at least one blade is outwardly movable from a refracted position to an extended position with respect to the first longitudinal axis. The expandable reamer also includes a first actuation device for moving the at least one blade from the refracted position to the extended position and a first electrical device configured to receive a first electronic signal and actuate the first actuation device responsive to the first electronic signal. The drilling assembly also includes an expandable stabilizer axially spaced from the expandable reamer, the expandable stabilizer has a second tubular body with a second longitudinal axis and a second drilling fluid flow path extending therethrough. A plurality of bearing pads is carried by the second tubular body, wherein at least one bearing pad of the plurality of bearing pads is outwardly movable from a refracted position to an extended position with respect to the second longitudinal axis. The expandable stabilizer also includes a second actuation device for moving the at least one bearing pad from the refracted position to the extended position and a second electrical device configured to receive a second electronic signal and actuate the second actuation device responsive to the second electronic signal.

In yet other embodiments, the present disclosure includes a method of forming a drilling assembly for drilling a subterranean wellbore. The method includes coupling an expandable stabilizer to an expandable reamer. The expandable reamer has a first tubular body with a first longitudinal axis and a first drilling fluid flow path extending therethrough. A plurality of blades is carried by the first tubular body, and a cutting structure is carried by at least one blade of the plurality of blades, wherein the at least one blade is outwardly movable from a refracted position to an extended position with respect to the first longitudinal axis for reaming a section of the wellbore. The expandable stabilizer has a second tubular body with a second longitudinal axis and a second drilling fluid flow path extending therethrough. A plurality of bearing pads is carried by the second tubular body, wherein at least one bearing pad of the plurality of bearing pads is outwardly movable from a refracted position to an extended position with respect to the second longitudinal axis. The method also includes axially locating the expandable stabilizer a distance of about 25 feet or less above the blades of the expandable reamer.

BRIEF DESCRIPTION OF THE DRAWINGS

While the specification concludes with claims particularly pointing out and distinctly claiming what are regarded as embodiments of the present disclosure, the advantages of embodiments of the disclosure may be more readily ascertained from the description of certain examples of embodiments of the disclosure when read in conjunction with the accompanying drawings, in which:

DETAILED DESCRIPTION

The illustrations presented herein are not meant to be actual views of any particular drilling assembly, component, structure, or device, but are merely idealized representations that are used to describe embodiments of the disclosure.

When used herein in reference to a location in the wellbore, the terms "above," "upper" and "uphole" mean and include a relative position proximate the surface of the well, whereas the terms "below," "lower" and "downhole" mean and include a relative position distal the surface of the well.

Figure 1:
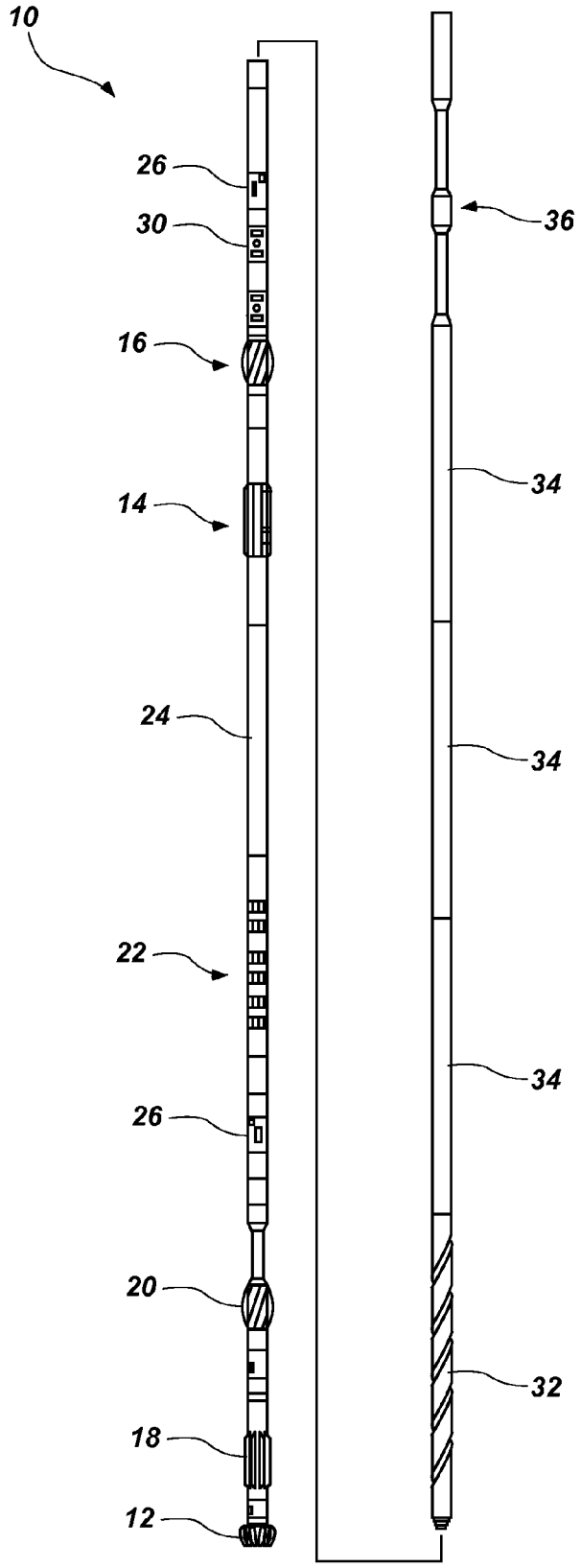
FIG. 1 is a schematic illustration of a bottom hole assembly including a drilling assembly that comprises an expandable reamer and an expandable stabilizer.

Referring now to FIG. 1, a downhole assembly is illustrated. The downhole assembly may comprise a so-called "bottom-hole assembly" (BHA) 10 used for reaming a well to a larger diameter than that initially drilled, for concurrently drilling and reaming a wellbore, or for drilling a wellbore. The bottom hole assembly 10, as illustrated, includes a pilot drill bit 12, an expandable reamer 14 and an expandable stabilizer 16. The bottom hole assembly 10 optionally may include various other types of drilling tools such as, for example, a steering unit 18, one or more additional stabilizers 20, a measurement while drilling (MWD) tool 22, one or more bi-directional communications pulse modules (BCPM) 24, one or more mechanics and dynamics tools 26, one or more electronic devices, which may include, for example, additional measurement devices or sensors 30, such as sonic calipers and RPM recognition devices. The bottom hole assembly 10 may additionally include one or more drill collars 32, one or more segments of electrically communicative drill pipe 34, and one or more heavyweight drill pipe (HWDP) segments 36. Components of the bottom hole assembly 10 may communicate with controllers and/or operators at the well surface in a variety of ways, including direct-line electronic communication and command pattern signals, as will be discussed in more detail below.

Figure 2:
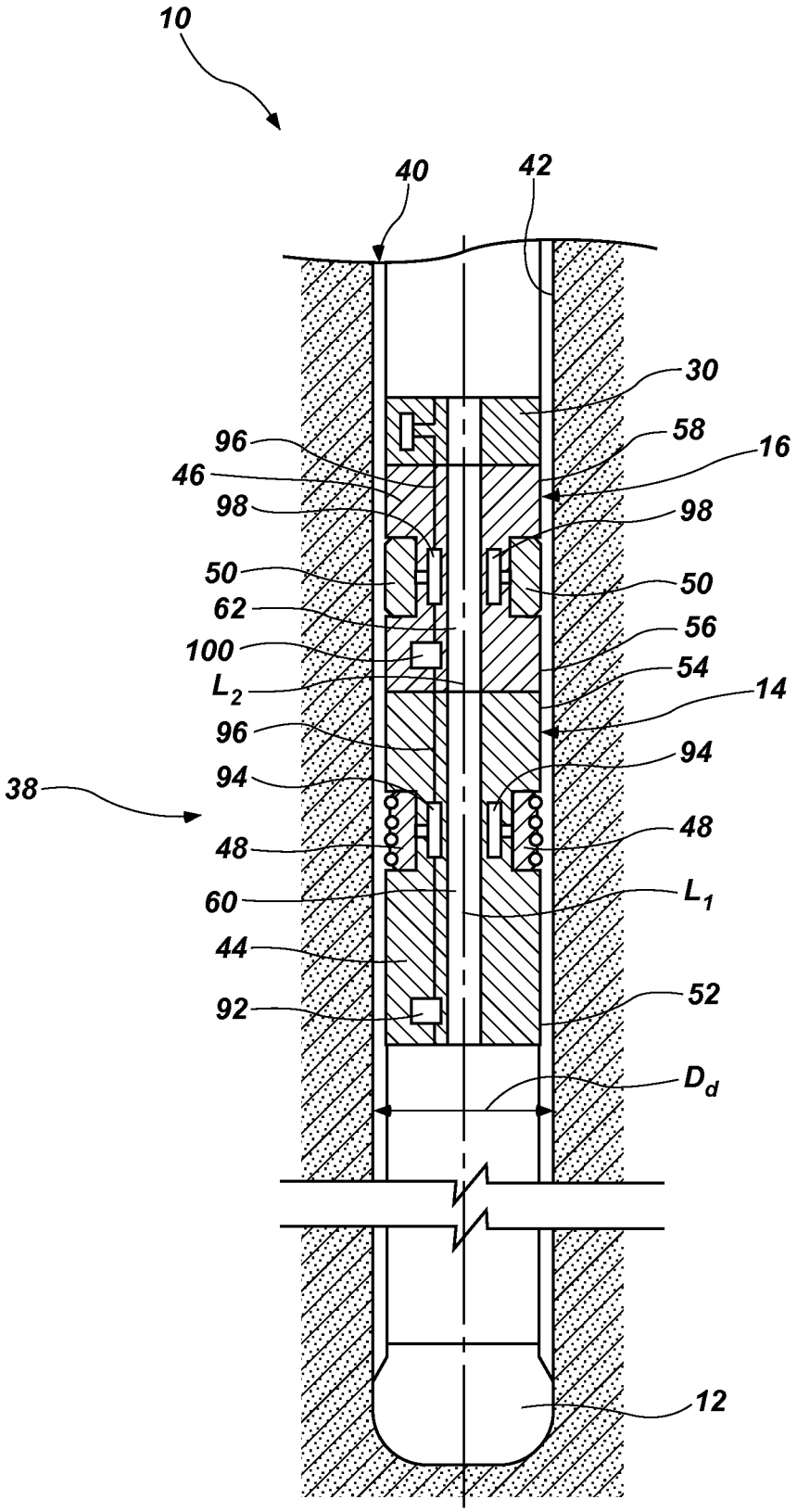
FIG. 2 is a simplified and schematic longitudinal cross-sectional view of a drilling assembly in a wellbore, the drilling assembly having an expandable stabilizer adjacent an expandable reamer.

FIG. 2 is a longitudinal schematic view of a drilling assembly reaming a wellbore in accordance with an embodiment of the present disclosure. A cross-section of a drilling assembly generally designated by reference numeral 38 is shown reaming a wellbore 40 extending through a formation 42 with an expandable reamer 14 having a first tubular body 44 directly and coaxially coupled below a second tubular body 46 of an expandable stabilizer 16. The expandable reamer 14 and the expandable stabilizer 16 include blades 48 and bearing pads 50, respectively. The blades 48 and bearing pads 50 may be positionally retained in circumferentially spaced relationships in the first and second tubular bodies 44, 46, respectively, and the blades 48 may have a cutting structure thereon for engaging the formation 42. Moreover, in one embodiment, the blades 48 and the bearing pads 50 may be symmetrically circumferentially positioned in their respective tubular bodies 44, 46, and in other embodiments, the blades 48 and bearing pads 50 may be positioned circumferentially asymmetrically in their respective tubular bodies 44, 46. The reamer blades 48 and stabilizer bearing pads 50 may also be provided at a position between a lower end 52, 56 and an upper end 54, 58 of the reamer 14 and stabilizer 16, respectively.

Figure 5:
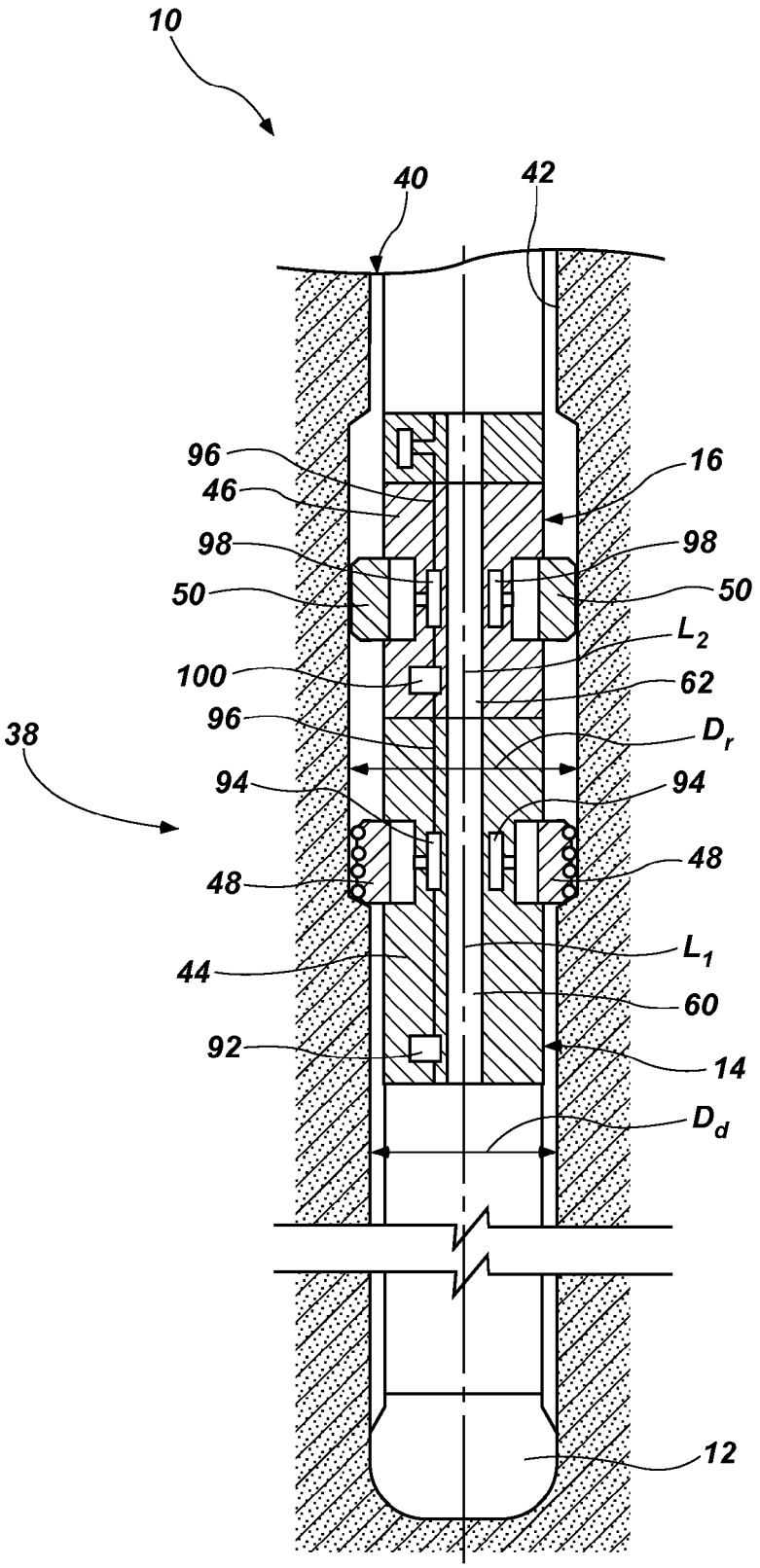
FIG. 5 is a simplified and schematic longitudinal cross-sectional view of the drilling assembly of FIG. 4 showing the bearing pads of the expandable stabilizer in the extended position engaging the wellbore.

The blades 48 and bearing pads 50 are each retained in an initial, refracted position within their respective tubular bodies 44, 46, as shown in FIG. 2, but may be moved outwardly from their respective longitudinal axes $L_1$, $L_2$ to the extended position, as shown in FIG. 5, and moved back into a retracted position when desired.

The expandable reamer 14, including the blades 48, may be configured as described in any of U.S. Pat. Nos. 8,020,635, issued Sep. 20, 2011 to Radford; U.S. Pat. No. 7,900,717, issued Mar. 8, 2011 to Radford et al.; U.S. Pat. No. 7,681,666, issued Mar. 23, 2010 to Radford et al.; U.S. Pat. No. 7,549,485, issued Jun. 23, 2009 to Radford et al.; U.S. Pat. No. 7,036,611, issued May 2, 2006 to Radford et al.; and United States Patent Publication Nos. 2011/0127044, published Jun. 2, 2011 to Radford et al.; 2011/0005836, published Jan. 13, 2011 to Radford et al.; and 2009/0294178, published Dec. 3, 2009 to Radford, the disclosure of each of which is hereby incorporated herein in its entirety by this reference. The expandable stabilizer 16, including the bearing pads 50, may be configured as described in any of United States Patent Publication Nos. 2011/0127044, published Jun. 2, 2011 to Radford et al., and 2009/0294178, published Dec. 3, 2009 to Radford, the disclosure of each of which is hereby incorporated herein in its entirety by this reference.

The reamer blades 48 and stabilizer bearing pads 50 may be operationally configured to extend and retract responsive to hydraulic pressure acting against the blades 48 and bearing pads 50, respectively, as described in U.S. Pat. Nos. 7,900, 717; 7,549,485; 8,020,635; and 7,681,666; and United States Patent Publication Nos. 2011/0127044 and 2009/0294178, each of which is referenced above and incorporated by reference herein.

In other embodiments, the reamer blades 48 and/or stabilizer bearing pads 50 may be configured for lateral outward extension by pressurized drilling fluid separately controlled by a closed-loop hydraulic system, as provided in U.S. Pat. Nos. 8,020,635; 7,681,666 and 7,549,485, and United States Patent Publication No. 2011/0127044, each of which referenced above and incorporated by reference herein. For example, the blades 48 and/or bearing pads 50 may be actuated by a piston element (not shown) coaxially aligned with the tubular body of the respective reamer 14 or stabilizer 16 and having a drilling fluid flow path extending through a central bore of the piston, as disclosed in United States Patent Publication No. 2011/0127044, referenced above. In such embodiments, the piston element may move axially as influenced by pressure of the drilling fluid flowing through the tubular bodies of the reamer 14 and stabilizer 16, which axial movement may bring lateral ports in the piston into fluid communication with lateral ports in a housing of the piston element, providing pressurized fluid flow directed to act against the blades 48 and/or bearing pads 50. The axial position of such a piston element may further be controlled by a sealed, closed-loop hydraulic system, comprising a first and second fluid chamber axially located on opposite sides of a laterally extending member of the piston. A bi-directional valve may be used to control the flow of the sealed hydraulic fluid within the first and second chambers in a manner to control the axial position of the laterally extending member of the piston. The valve may be controlled by a unit including a processor, memory device and software programs.

In still further embodiments, pressurized hydraulic fluid in a controlled, closed-loop hydraulic system may directly displace a reamer blade 48 or stabilizer bearing pad 50, as disclosed in U.S. Pat. Nos. 8,020,635; 7,681,666 and 7,549,485, each of which is referenced above and incorporated by reference herein. In such embodiments, the pressurized hydraulic fluid may be communicated to a chamber housing a portion of a lateral piston element coupled to the blade 48 or bearing pad 50. The pressurized fluid may be communicated to the chamber by way of a pressure source, such as a downhole pump or turbine operatively coupled to a control valve apparatus. The control valve apparatus may be selectively and reversibly operable, and may comprise a solenoid actuated valve.

It is to be appreciated that any of the embodiments of the references incorporated by reference herein may be modified and reconfigured in accordance with the teachings of the present disclosure. Furthermore, any conventional expandable reamer or expandable stabilizer modified and reconfigured in accordance with the teachings of the disclosure herein may be utilized to advantage to provide an improved system or drilling assembly for stabilizing the drill string while performing a reaming operation. Additionally, the reamer blades 48 and/or the stabilizer bearing pads 50 may be configured for lateral outward extension by any other mechanical means, such as a push rod, wedge or actuating motor or as conventionally understood to a person having ordinary skill in the art of expandable reamers and/or expandable stabilizers.

The expandable stabilizer 16 may be coupled directly to the expandable reamer 14, as shown in FIGS. 2 through 5, or an intermediate piece of the drill string may be positioned between the reamer 14 and stabilizer 16. Referring to FIGS. 2 through 5, the expandable stabilizer 16 may be positioned in the drilling assembly 38 to be in the range of about 10 feet to 35 feet above the expandable reamer 14, regardless of whether the reamer 14 and stabilizer 16 are directly or indirectly coupled together. The axial distance between the reamer 14 and stabilizer 16 may be measured from the center of the stabilizer bearing pad 50 in the refracted position to the center of the reamer blade 48 in the retracted position. The close proximity of the expandable stabilizer 16 to the expandable reamer 14 provides increased operational stability for the drill string during reaming operations.

Figure 3:
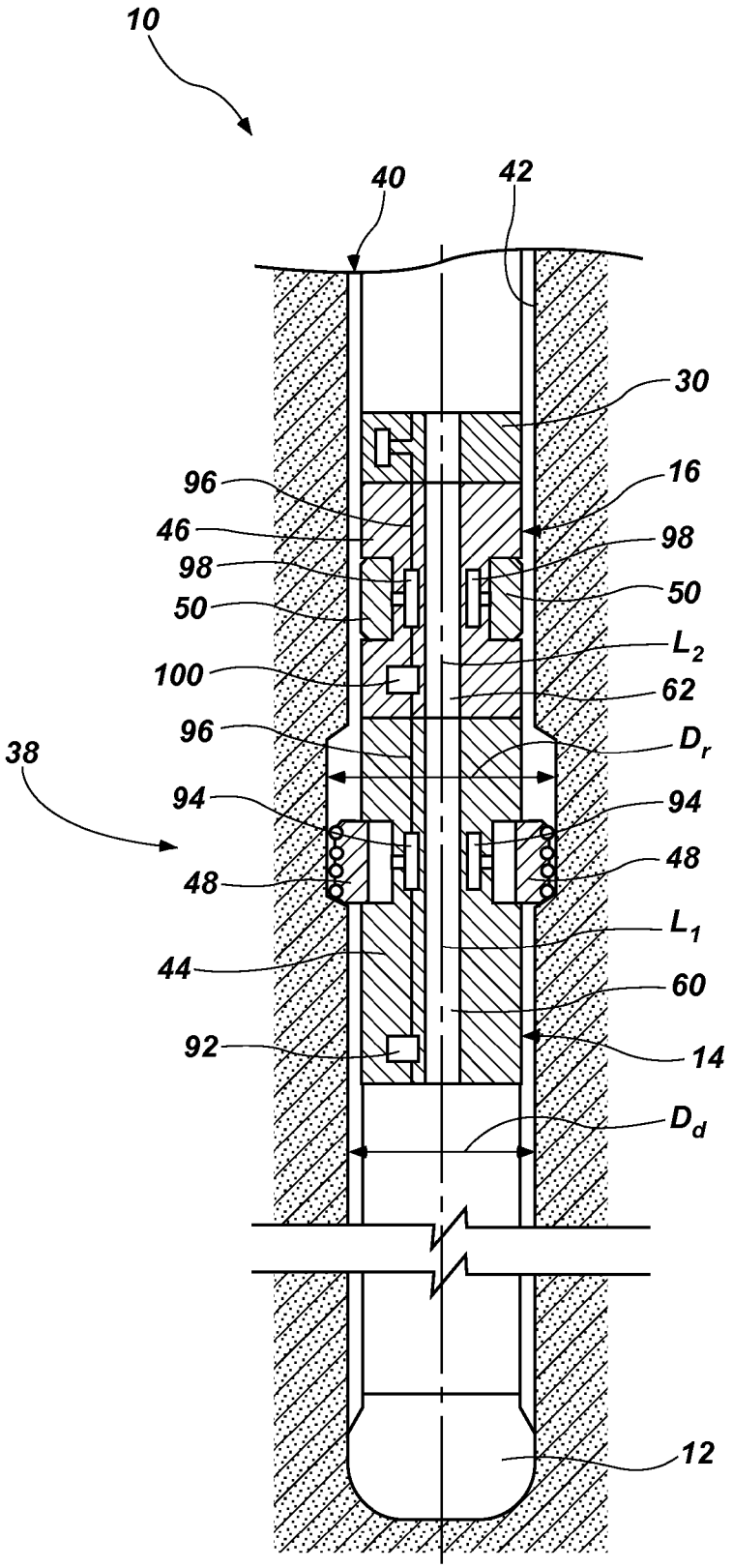
FIG. 3 is a simplified and schematic longitudinal cross-sectional view of the drilling assembly of FIG. 2 showing the blades of the expandable reamer in the extended position engaging the wellbore.
Figure 4:
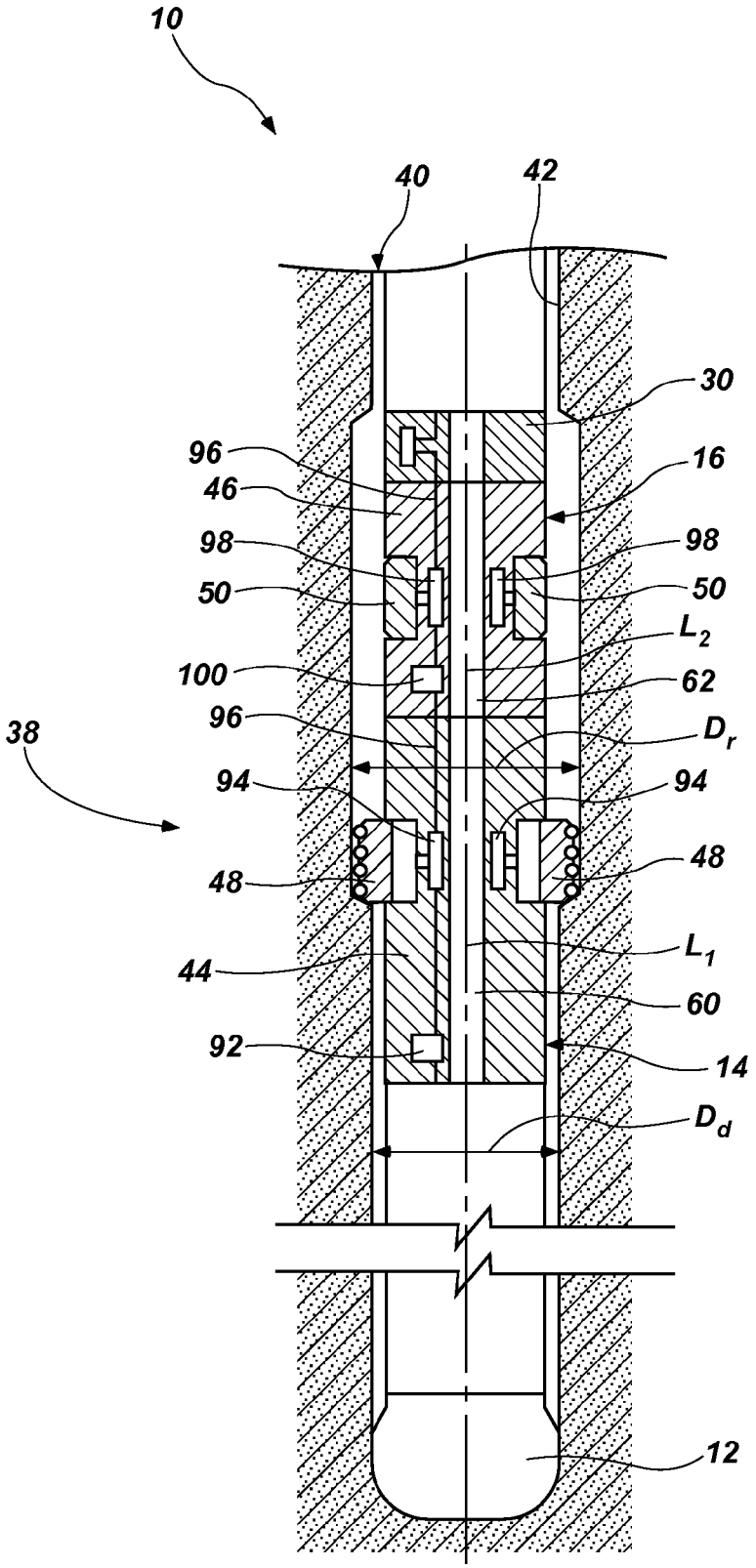
FIG. 4 is a simplified and schematic longitudinal cross-sectional view of the drilling assembly of FIG. 3 having reamed a section of the wellbore.

The expandable stabilizer 16, when positioned above and proximate the expandable reamer 14, helps to reduce vibration and stabilize the expandable reamer 14 as the wellbore 40 is reamed to a larger diameter, or reamed diameter, $D_r$, above the smaller drilled diameter, $D_d$. FIGS. 3 through 5 illustrates the drilling assembly 38 having enlarged the diameter of wellbore 40 in the "down-hole" direction with the blades 48 being fully extended to remove the material of the formation 42. As shown in FIG. 5, the expandable reamer 14 is stabilized by the fully extended bearing pads 50 of the expandable stabilizer 16 making stabilizing contact with the wall of the wellbore 40 above the expandable reamer 14.

Referring to FIGS. 2 through 5, the expandable reamer 14 may have a first generally tubular body 44 having a first drilling fluid flow path 60 extending therethrough along a first longitudinal axis $L_1$. Similarly, the expandable stabilizer 16 may have a second generally tubular body 46 having a second drilling fluid flow path 62 extending therethrough along a second longitudinal axis $L_2$. The first and second longitudinal axes $L_1$, $L_2$ axes may be co-axially aligned.

Actuation of the expandable reamer 14 and the expandable stabilizer 16 may be controlled by a surface operator. The embodiments of the present disclosure provide the surface operators with a variety of options to separately control actuation of the reamer 14 and stabilizer 16, via direct-line electronic command signals, or, alternatively, command pattern signals which may be sensed downhole and relayed to the drilling assembly 38. Additionally, one or both of the reamer 14 and stabilizer 16 may be actuated automatically upon the recognition of a predetermined parameter by a downhole sensor. The embodiments of the assembly 38 illustrated in FIGS. 2 through 5 are capable of providing actuation control of the assembly 38 according to any of such methods, as will now be described. It is to be appreciated that the embodiments illustrated in FIGS. 2 through 5 do not employ a ball trap mechanism.

As shown in FIGS. 2 through 5, the expandable reamer blades 48 may be operationally coupled to a first actuation device 94 located in or on the first tubular body 44. Also located in or on the first tubular body 44 is a first electrical device 92 operatively coupled to the first actuation device 94 and in electronic communication with a first electronic signal source (not shown). It is to be appreciated that a variety of alternative components may comprise the first electronic signal source, and such components may be positioned in a wide variety of locations relative to the drill string. For example, if the reamer 14 is controlled by direct-line electronic command signals, the first electronic signal source may be a switch or computer at the controller's work station on a drilling rig at the well surface, by way of a non-limiting example. If the reamer 14 is at least partially controlled by command pattern signals, such as mud pulses sent downhole, the first electronic signal source may alternatively be a downhole sensor 30, such as a pressure sensor with a microprocessor that interprets the command pattern signal and responsively transmits the first electronic signal to the reamer 14. Such signal sources may also be the signal source for the expandable stabilizer 16, as discussed in more detail below.

The first electrical device 92 may communicate with the first electronic signal source by one or more lines or wires 96 extending the length of the first tubular body 44 and electronically coupling the first electrical device 92 to additional components of the drill string, such as one or more BCPMs, sections of electrically communicative drill pipe, and downhole sensors 30, such as RPM recognition devices, accelerometers, pressure sensors, sonic calipers, and flow meters, as further disclosed below. The wires 96 may be located on an outer surface or inner surface of the first tubular body 44, or may be located within the body material thereof. Upon receiving a first electronic signal from the first electronic signal source, the first electrical device 92 may actuate the first actuation device 94, moving the reamer blades 48 from the retracted position to the extended position, as shown in FIG. 3. The first actuation device 94 may be configured to move the reamer blades 48 to the extended position by using any of the mechanisms and methods disclosed above.

As described above, the expandable stabilizer 16 may be configured similar to the configuration of the expandable reamer 14. The expandable stabilizer 16 may have a second generally tubular body 46 having a second drilling fluid flow path 62 extending therethrough along a second longitudinal axis $L_2$. The expandable bearing pads 50 may be operationally coupled to a second actuation device 98 located in or on the second tubular body 46. Also located in the second tubular body 46 is a second electrical device 100 operatively coupled to the second actuation device 98 and in electronic communication with a second electronic signal source. Similarly to the first electronic signal source, as discussed above, it is to be appreciated that a variety of alternative components may comprise the second electronic signal source. Moreover, the second electronic signal source may be the same as the first electronic signal source; although, in additional embodiments, the second electronic source may be separate from the first electronic source, as will be described in more detail below. The second electrical device 100 may communicate with the second electronic signal source by one or more wires 96 extending the length of the second tubular body 46 and electronically coupling the second electrical device 100 with additional components of the drill string, as further disclosed below. The wires 96 may be located on an outer surface or inner surface of the second tubular body 46, or may be located within the body 46. Upon receiving a second electronic signal from the second electronic signal source, the second electrical device 100 may actuate the second actuation device 98, moving the stabilizer bearing pads 50 from the refracted position to the extended position, as shown in FIG. 5. The second actuation device 98 may be configured to move the stabilizer bearing pads 50 to the extended position by using any of the mechanisms and methods disclosed above.

It is to be appreciated that the expandable reamer blades 48 and bearing pads 50 may be retracted similar to the manner in which they are extended. For example, upon receiving another electronic signal, the first electrical device 92 may actuate the first actuation device 94 in a manner to move the reamer blades 48 from the extended position to the retracted position. Similarly, upon receiving yet another electronic signal, the second electrical device may actuate the second actuation device 98 in a manner to move the stabilizer bearing pads 50 from the extended position to the retracted position. Alternatively, the first and second electrical devices 92, 100 may respectively actuate the first and second actuation devices 94, 98 upon reception of the same electronic signal. In additional embodiments, retention elements (not shown), such as springs or other retention elements, may respectively retract the reamer blades 48 and bearing pads 50 from the extended position to the refracted position upon deactivation of the first and second actuation devices 94, 98, respectively, by the first and second electrical devices 92, 100.

The first tubular body 44 and the second tubular body 46 each have respective lower ends 52, 56 and upper ends 54, 58. The lower ends 52, 56 may include a set of threads (e.g., a threaded-male pin member) (not shown) for connecting the lower ends 52, 56 to another component of the drill string or bottom-hole assembly, such as, for example, a drill collar or collars carrying a pilot drill bit 12 for drilling the wellbore 40. Similarly, the upper ends 54, 58 of the first tubular body 44 and the second tubular body 46 may include a set of threads (e.g., a threaded-female box member) (not shown) for connecting the upper ends 54, 58 to a set of threads (e.g., a threaded-male pin member) to another component of the drill string or bottom-hole assembly. By way of example and not limitation, the threaded-female box member at the lower end 56 of the stabilizer 46 may be threadedly connected to the corresponding threaded-male pin member at the upper end 54 of the reamer 44. In other embodiments, the threaded-female box member at the lower end 56 of the stabilizer 46 may be threadedly connected to a drill collar, and a lower end of the drill collar may be threadedly connected to the threaded-male pin member at the upper end 54 of the reamer 44. The threads in the lower and upper ends of the reamer 14 and stabilizer 16 can be of any suitable type for mating with another section of a drill string or another component of a bottom-hole assembly. Moreover, the threads at the respective upper ends 54, 58 and lower ends 52, 56 of the first and second tubular body 44, 46 may be configured with an electrical contact pad or ring (not shown) electrically coupled with the one or more wires 96 extending the length of the respective first and second tubular body 44, 46. The electrical contact pad or ring may be configured to engage a corresponding electrical contact pad or ring in the threads of a matting component of the bottom-hole assembly. In this manner, some or all of the components of the bottom-hole assembly may be in electronic communication with one another.

The drill string may also contain one or more sections of electrically communicative drill pipe 34 (shown in FIG. 1), which are necessary if the assembly 38 is to be controlled by direct-line electronic commands sent from a surface controller. Sections of electrically communicative drill pipe 34 are configured with one or more electronic wires 96 (not shown) extending the length of the pipe section 34. The wires 96 may be located on an outer surface or inner surface of the pipe section 34, or may be located within the body material of the pipe 34. A lower end of each pipe section 34 may include a set of threads (e.g., a threaded-male pin member) (not shown) for connecting the lower end to another pipe section or another component of a bottom-hole assembly. Similarly, the upper end of the pipe section 34 may include a set of threads (e.g., a threaded-female box member) for connecting the upper end to a set of threads (e.g., a threaded-male pin member) of another pipe section 34 or another component of the bottom-hole assembly. The threads in the lower and upper ends of the pipe section 34 can be of any suitable type for mating with another section of a drill string or another component of a bottom-hole assembly. Moreover, the threads at the upper and lower ends of each pipe section 34 may be configured with an electrical contact pad or ring (not shown) electrically coupled with the one or more wires 96 extending the length of the pipe section. The electrical contact pad or ring may be configured to engage a corresponding electrical contact pad or ring in the threads of a matting pipe section 34 or component of the bottom-hole assembly. In this manner, some or all of the components of the bottom-hole assembly may be in electronic communication with the surface or with other sections of the drill string.

Figure 6:
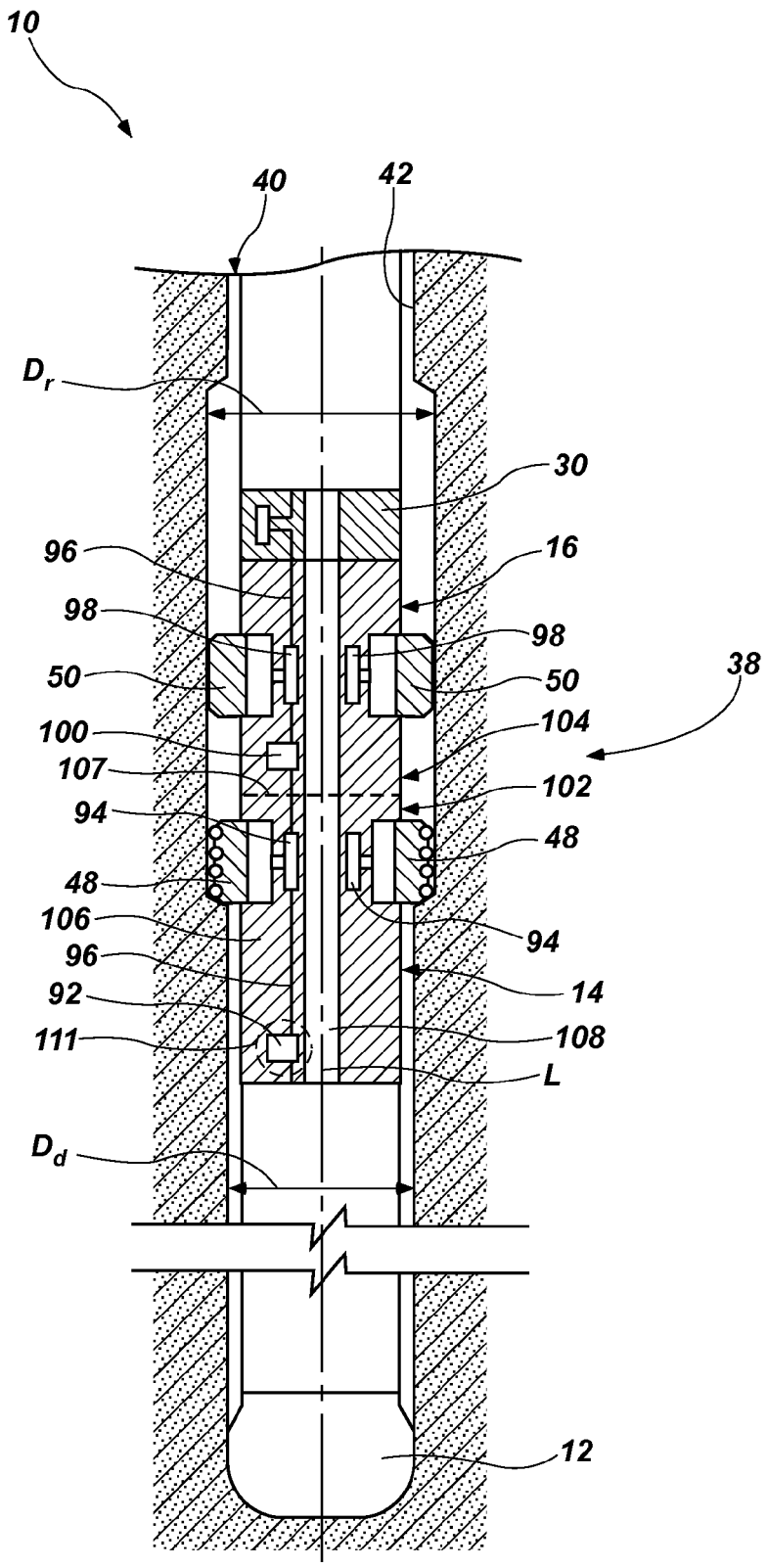
FIG. 6 is a simplified and schematic longitudinal cross-sectional view of another embodiment of a drilling assembly including an expandable reamer and an expandable stabilizer comprising separate portions of a unitary tubular body.

Referring now to FIG. 6, a drilling assembly 38 is shown wherein the expandable reamer 16 and the expandable stabilizer 14 comprise respective first and second portions 102, 104 of a single unitary tubular body 106, as indicated by broken line 107. The unitary tubular body 106 has a drilling fluid flow path 108 extending therethrough along a longitudinal axis L. Similar to the drilling assembly 38 shown in FIGS. 2 through 5, the expandable reamer blades 48 and the expandable bearing pads 50 of the unitary tubular body 106 may be operationally coupled to first and second actuation devices 94, 98, respectively, located in or on the tubular body 106. Also located in or on the unitary tubular body 106 are first and second electrical devices 92, 100 operatively coupled to the first and second actuation devices 94, 98, respectively. The first and second electrical devices 92, 100 may communicate with (e.g., receive electronic signals from) one or more electronic signal sources by one or more wires 96 extending the length of the unitary tubular body 106 and electronically coupling the first and second electrical devices 92, 100 to one another and to additional components of the drill string. The wires 96 may be located on an outer surface or inner surface of the unitary tubular body 106 or may be located within the body 106. As discussed above in reference to FIGS. 2 through 5, a variety of alternative components may comprise the electronic signal sources. Furthermore, such components may be positioned in a wide variety of locations relative to the drill string. Referring again to FIG. 6, the first and second electrical devices 92, 100 may respectively actuate the first and second actuation devices 94, 98 in the same manner as disclosed above in reference to FIGS. 2 through 5, and the first and second actuation devices 94, 98 may be configured to move the blades 48 and bearing pads 50, respectively, outwardly from the refracted position to the extended position by using any of the mechanisms and method disclosed above. It is to be appreciated that the embodiments illustrated in FIGS. 6 and 7 do not employ a ball trap mechanism.

Figure 7:
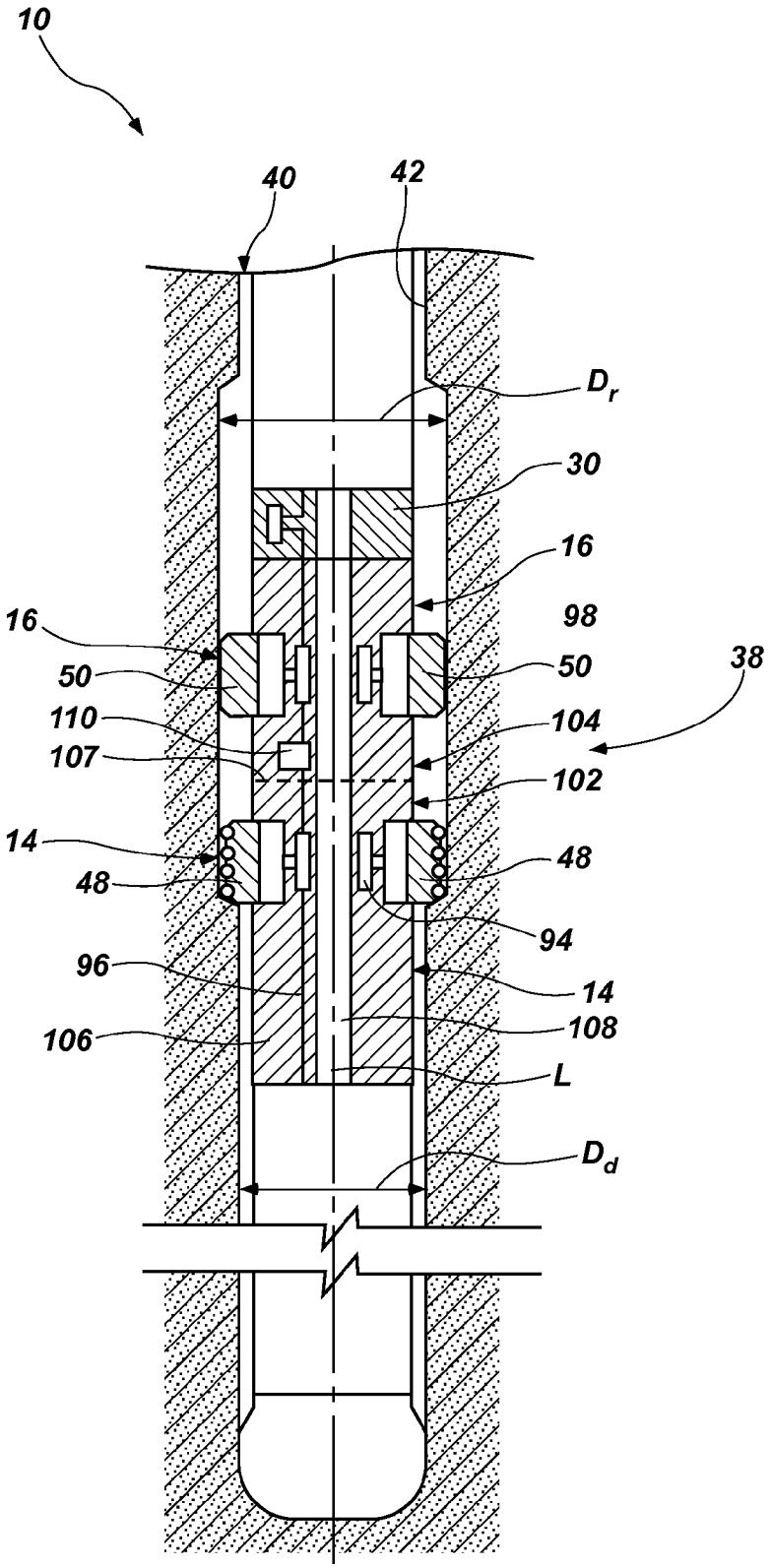
FIG. 7 is a simplified and schematic longitudinal cross-sectional view of another embodiment of a drilling assembly having a single electrical device for actuating the blades and bearing pads of an expandable reamer and an expandable stabilizer, respectively.

Referring to FIG. 7, the unitary tubular body 106 may alternatively comprise a single electrical device 110 that actuates both the first actuation device 94 and the second actuation device 98. The electrical device 110 may communicate with one or more electronic signal sources by one or more wires 96 extending the length of the unitary tubular body 106 and coupling the electrical device 110 to additional components of the drill string. As discussed above, a variety of alternative components may comprise the electronic signal sources. Furthermore, such signal source components may be positioned in a wide variety of locations relative to the drill string. Referring again to FIG. 7, upon receiving the first electronic signal, the electrical device 110 may actuate the first actuation device 94 to expand the reamer blades 48 to the extended position, and upon receiving the second electronic signal, the electrical device 110 may actuate the second actuation device 98 to expand the stabilizer bearing pads 50 to the extended position. The first and second actuation devices 94, 98 may be configured to move the blades 48 and bearing pads 50, respectively, outwardly from the refracted position to the extended position by using any of the mechanisms and method disclosed above.

Figure 8:
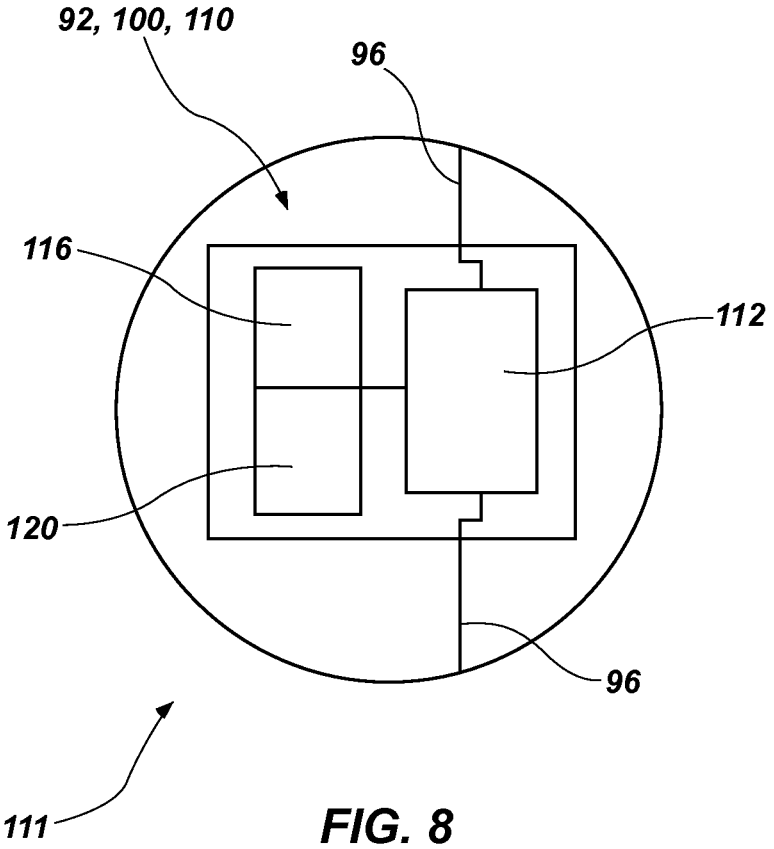
FIG. 8 is a simplified and schematic illustration of an electrical device of a drilling assembly, which may be employed to blades of an expandable reamer and/or pads of an expandable stabilizer of the drilling assembly.

FIG. 8 illustrates a representative embodiment of the first and second electrical devices 92, 100, and is indicated by broken circle 111 in FIG. 6. The first and second electrical devices 92, 100 may each comprise a processor 112 and a memory device 116, wherein one or more software programs 120 are configured to run on the processors 112 and memory devices 116. The processors 112 may be microprocessors configured to respectively control the first and second actuation devices 94, 98. As disclosed above, each of the first and second actuation devices 94, 98 may comprise a closed loop hydraulic (not shown). In such embodiments, the processors 112 may each be coupled to a control valve unit, which may comprise a solenoid actuated valve, for selectively controlling flow of hydraulic fluid to control the position of the blades 48 and bearing pads 50, respectively.

The processors 112 may be configured to actuate the first and second actuation devices 94, 98 responsive to any of the control methods discussed above. In some embodiments, one or both of the expandable reamer 14 and the expandable stabilizer 16 may be controlled by direct-line electronic signals sent directly from a surface controller and transmitted through the drill string via wire lines or through sections of electrically communicative drill pipe 34 (shown in FIG. 1) to the first and second electrical devices 92, 100. The direct-line electronic signals may comprise one or both of the first and second electronic signals discussed above. The direct-line electronic signal may be received by the first and second electrical devices 92, 100, wherein the first and second actuation devices 94, 98 are actuated based on the control of the respective processors 112, memory devices 116, and software programs 120 operating respectively within the first and second electrical devices 92, 100.

In other embodiments, one or both of the expandable reamer 14 and the expandable stabilizer 16 may be controlled by command patterns sent downhole by a surface controller. The command patterns may be any signal that allows communication between the surface drilling rig and a downhole tool, such as changes in drill string rotation rate (revolutions per minute, or "RPM"), changes in mud pulse frequency, changes in flow rates of the drilling fluid, and axial motion of the drill string.

One example of a command pattern signal comprises a predefined sequence of rotational speed (revolutions per minute (RPM)) duration periods may be used to provide a command pattern signal that is detected downhole by a sensor 30, such as an RPM recognition device, which may comprise an accelerometer, which may control one or both of the expandable reamer 14 and the expandable stabilizer 16. By way of a non-limiting example, the drill string may be rotated by a drilling rig at 40 RPM for 10 seconds, followed by a rotation of 20 RPM for 30 seconds, where one or more sensors 30 detect the drill string rotational speed. The RPM recognition device may include a processor (not shown), which transforms the detected rotation speeds into an electronic data signal and transmits the electronic data signal to the processors 112 through one or more wires 96, as described above, or another signal communication pathway. The processors 112 decode the pattern of rotational speeds and durations by comparing the data signal to patterns stored in the memory devices 116 corresponding to predetermined positions of the blades 48 and/or bearing pads 50. When the processors 112 identify a stored pattern corresponding to the pattern communicated by the data signal, the processors may respectively actuate the first and second actuation devices 94, 98 to move the blades 48 and/or bearing pads 50 to the corresponding predetermined positions.

Another example of a command pattern signal comprises a sequence of pulses of hydraulic pressure in the drilling fluid, or "mud pulses," as known in the art, of a varying parameter, such as duration, amplitude and/or frequency, that may be detected by a pressure sensor in the bottom-hole assembly. The pressure sensor may be located in a BCPM positioned in the bottom-hole assembly (shown in FIG. 1), as known in the art. The BCPM may comprise a processor (not shown), which transforms the detected mud pulse pattern, including one or more of pressure, frequency and amplitude, into an electronic data signal and transmits the electronic data signal to the processors 112 through one or more wires 96, as described above, or another signal communication pathway. The processors 112 decode the pattern communicated by the data signal by comparing the data signal to patterns stored in the memory devices 116 corresponding to predetermined positions of the blades 48 and/or bearing pads 50. When the processors 112 identify a stored pattern corresponding to the pattern communicated by the data signal, the processors 112 may respectively actuate the first and second actuation devices 94, 98 to move the blades 48 and/or bearing pads 50 to the corresponding predetermined position.

In additional embodiments, one or both of the expandable reamer 14 and the expandable stabilizer 16 may be controlled automatically or independently based on sensed downhole parameters, such as the diameter of the wellbore proximate the stabilizer bearing pads 50. For example, a measurement device, such as a sonic caliper, which may be represented by sensor 30 in FIGS. 2 through 7, may be configured to measure the diameter of the wellbore 40 proximate the stabilizer bearing pads 50. The sonic caliper may have a microprocessor (not shown) which transmits an electronic signal to the second electrical device 100 when the diameter of the wellbore 40 proximate the bearing pads 50 corresponds to the reamed diameter $D_r$ of the wellbore 40. Upon receiving the electronic signal from the sonic caliper, the processor 82 of the second electrical device 100 may actuate the second actuation device 98 to move the stabilizer bearing pads 50 to a predetermined position corresponding to the reamed diameter $D_r$ of the wellbore 40. Thus, the drilling assembly 38 may be configured to expand the stabilizer bearing pads 50 automatically after the reamer 14 has reamed a portion of the borehole corresponding to the axial distance between the stabilizer bearing pads 50 and the reamer blades 48.

It is to be appreciated that the drilling assembly 38 comprising the expandable reamer 14 and the expandable stabilizer 16 may be controlled by any combination of the control methods described above. For example, in one embodiment, both the first and second actuation devices 94, 98 may respectively move the reamer blades 48 and stabilizer bearing pads 50 responsive to a direct electronic signal sent from a surface controller.

In an additional embodiment, the first actuation device 94 may move the reamer blades 48 responsive to a direct electronic signal sent from a surface controller while the second actuation device 98 may move the stabilizer bearing pads 50 responsive to a pattern command sent downhole from a surface controller and detected by a downhole sensor.

In yet additional embodiments, the first actuation device 94 may move the reamer blades 48 responsive to a direct electronic signal sent from a surface controller while the second actuation device 98 may automatically move the stabilizer bearing pads 50 responsive to a sensed downhole parameter, such as when the diameter of the wellbore 40 proximate the stabilizer bearing pads 50, as sensed by a sonic caliper, corresponds to the reamed diameter $D_r$ of the wellbore 40.

In yet further additional embodiments, both the first and second actuation devices 94, 98 may respectively move the reamer blades 48 and stabilizer bearing pads 50 responsive to command patterns sent downhole from a surface controller and detected by one or more downhole sensors.

In still yet further additional embodiments, the first actuation device 94 may move the reamer blades 48 responsive to a command pattern sent downhole from a surface controller and detected by a downhole sensor while the second actuation device may 74 may move the stabilizer bearing pads 50 responsive to a direct electronic signal sent from a surface controller.

In other further additional embodiments, the first actuation device 94 may move the reamer blades 48 responsive to a command pattern sent downhole from a surface controller and detected by a downhole sensor while the second actuation device 98 may automatically move the stabilizer bearing pads 50 responsive to a sensed downhole parameter, such as when the diameter of the wellbore 40 proximate the stabilizer bearing pads 50, as sensed by a sonic caliper, corresponds to the reamed diameter $D_r$ of the wellbore 40.

It is to be appreciated that one or both of the blades 48 and bearing pads 50 may be refracted from the extended position to the refracted position by any of the methods and mechanisms described above.

Additional non-limiting example embodiments of the present disclosure are set forth below.

Embodiment 1: A drilling assembly for drilling a subterranean wellbore, comprising: an expandable reamer comprising a first tubular body having a first longitudinal axis and a first drilling fluid flow path extending therethrough, a plurality of blades carried by the first tubular body, and a cutting structure carried by at least one blade of the plurality of blades, wherein at least one blade of the plurality of blades is outwardly movable from a refracted position to an extended position with respect to the first longitudinal axis; and an expandable stabilizer axially located a distance of about 25 feet or less above the expandable reamer in the drilling assembly, the expandable stabilizer comprising a second tubular body having a second longitudinal axis and a second drilling fluid flow path extending therethrough, a plurality of bearing pads carried by the second tubular body, wherein at least one bearing pad of the plurality of bearing pads is outwardly movable from a retracted position to an extended position with respect to the second longitudinal axis.

Embodiment 2: The drilling assembly of Embodiment 1, wherein the first tubular body of the expandable reamer and the second tubular body of the expandable stabilizer are separate tubular bodies coupled directly together.

Embodiment 3: The drilling assembly of Embodiment 1, wherein the first tubular body of the expandable reamer and the second tubular body of the expandable stabilizer comprise different regions of a unitary tool body.

Embodiment 4: The drilling assembly of any one of Embodiments 1 through 3, wherein the bearing pads are located a distance in a range extending from about 10 feet to about 15 feet above the blades.

Embodiment 5: The drilling assembly of any one of Embodiments 1 through 4, wherein the bearing pads are located a distance in a range extending from about 15 feet to about 25 feet above the blades.

Embodiment 6: The drilling assembly of any one of Embodiments 1 through 5, wherein the first longitudinal axis of the expandable reamer is co-axial with the second longitudinal axis of the expandable stabilizer.

Embodiment 7: A drilling assembly for drilling a subterranean wellbore, comprising: an expandable reamer comprising a first tubular body having a first longitudinal axis and a first drilling fluid flow path extending therethrough, a plurality of blades carried by the first tubular body, and a cutting structure carried by at least one blade of the plurality of blades, wherein the at least one blade is outwardly movable from a refracted position to an extended position with respect to the first longitudinal axis, the expandable reamer further comprising a first actuation device for moving the at least one blade from the refracted position to the extended position and a first electrical device configured to receive a first electronic signal and actuate the first actuation device responsive to the first electronic signal; and an expandable stabilizer axially spaced from the expandable reamer and comprising a second tubular body having a second longitudinal axis and a second drilling fluid flow path extending therethrough, a plurality of bearing pads carried by the second tubular body, wherein at least one bearing pad of the plurality of bearing pads is outwardly movable from a retracted position to an extended position with respect to the second longitudinal axis, the expandable stabilizer further comprising a second actuation device for moving the at least one bearing pad from the refracted position to the extended position and a second electrical device configured to receive a second electronic signal and actuate the second actuation device responsive to the second electronic signal.

Embodiment 8: The drilling assembly of Embodiment 7, further comprising a bi-directional communication pulse module (BCPM) configured to transmit the first electronic signal to the first electrical device of the expandable reamer.

Embodiment 9: The drilling assembly of Embodiment 8, wherein the BCPM is configured to transmit the second electronic signal to the second electrical device of the expandable stabilizer.

Embodiment 10: The drilling assembly of any one of Embodiments 7 through 9, further comprising a sensor device configured to indicate a diameter of the wellbore proximate the expandable stabilizer, the sensor device comprising an electronic device configured to transmit the second electronic signal to the second electrical device of the expandable stabilizer when the diameter of the wellbore corresponds to a predetermined diameter.

Embodiment 11: The drilling assembly of any one of Embodiments 7 through 10, further comprising at least one section of electrically communicative drill pipe located in the drilling assembly, the at least one section of electrically communicative drill pipe providing an electrical interconnection between two components of the drilling assembly coupled directly to opposing ends of the at least one section of electrically communicative drill pipe, wherein the first electronic signal is transmitted through the at least one section of electrically communicative drill pipe to the first electrical device of the expandable reamer.

Embodiment 12: The drilling assembly of any one of Embodiments 7 through 11, wherein the second electronic signal is transmitted through the at least one section of electrically communicative drill pipe to the second electrical device of the expandable stabilizer.

Embodiment 13: The drilling assembly of any one of Embodiments 7 through 12, further comprising a revolution-per-minute (RPM) recognition device configured to transmit the second electronic signal to the second electrical device of the expandable stabilizer responsive to detection of a predetermined series of operating revolution-per-minute intervals.

Embodiment 14: The drilling assembly of any one of Embodiments 7 through 13, wherein the first actuation device does not comprise a ball trap mechanism.

Embodiment 15: The drilling assembly of any one of Embodiments 7 through 14, wherein the first actuation device comprises at least one of a downhole pump and a downhole turbine configured to pressurize hydraulic fluid enclosed and sealed within the first tubular body of the expandable reamer.

Embodiment 16: The drilling assembly of any one of Embodiments 7 through 15, wherein the second actuation device does not comprise a ball trap mechanism.

Embodiment 17: The drilling assembly of any one of Embodiments 7 through 16, wherein the second actuation device comprises at least one of a downhole pump and a downhole turbine configured to pressurize hydraulic fluid enclosed and sealed within the second tubular body of the expandable stabilizer.

Embodiment 18: A method of forming a drilling assembly for drilling a subterranean wellbore, comprising: coupling an expandable stabilizer to an expandable reamer, the expandable reamer comprising a first tubular body having a first longitudinal axis and a first drilling fluid flow path extending therethrough, a plurality of blades carried by the first tubular body, and a cutting structure carried by at least one blade of the plurality of blades, wherein the at least one blade is outwardly movable from a retracted position to an extended position with respect to the first longitudinal axis for reaming a section of the wellbore, the expandable stabilizer comprising a second tubular body having a second longitudinal axis and a second drilling fluid flow path extending therethrough, a plurality of bearing pads carried by the second tubular body, wherein at least one bearing pad of the plurality of bearing pads is outwardly movable from a retracted position to an extended position with respect to the second longitudinal axis; and axially locating the expandable stabilizer a distance of about 25 feet or less above the blades of the expandable reamer.

Embodiment 19: The method of Embodiment 18, wherein coupling the expandable stabilizer to the expandable reamer comprises forming the expandable stabilizer and the expandable reamer to comprise different regions of a unitary tubular body.

Embodiment 20: The method of Embodiment 18 or Embodiment 19, further comprising configuring the at least one outwardly movable bearing pad to move from the retracted position to the extended position at least substantially automatically after the expandable reamer has reamed a section of the wellbore having a length equal to or greater than the distance the expandable stabilizer is axially located above the blades of the expandable reamer.

While certain illustrative embodiments have been described in connection with the figures, those of ordinary skill in the art will recognize and appreciate that embodiments of the present disclosure are not limited to those embodiments explicitly shown and described herein. Rather, many additions, deletions, and modifications to the embodiments described herein may be made without departing from the scope of embodiments of the present disclosure as hereinafter claimed, including legal equivalents. In addition, features from one disclosed embodiment may be combined with features of another disclosed embodiment while still being encompassed within the scope of embodiments of the present disclosure as contemplated by the inventor.

What is claimed is:

1. A drilling assembly for drilling a subterranean wellbore, comprising:

an expandable reamer comprising a first tubular body having a first longitudinal axis and a first drilling fluid flow path extending therethrough, a plurality of blades carried by the first tubular body, and a cutting structure carried by at least one blade of the plurality of blades, wherein at least one blade of the plurality of blades is outwardly movable from a retracted position to an extended position with respect to the first longitudinal axis responsive to a first electronic signal received by a first electrical device located in the first tubular body, and the first electrical device comprises a first processor; and an expandable stabilizer axially located a distance of about 25 feet or less above the expandable reamer in the drilling assembly, the expandable stabilizer comprising a second tubular body having a second longitudinal axis and a second drilling fluid flow path extending therethrough, a plurality of bearing pads carried by the second tubular body, wherein at least one bearing pad of the plurality of bearing pads is outwardly movable from a retracted position to an extended position with respect to the second longitudinal axis responsive to a second electronic signal received by a second electrical device located in the second tubular body, and the second electrical device comprises a second processor.

2. The drilling assembly of claim 1, wherein the first tubular body of the expandable reamer and the second tubular body of the expandable stabilizer are separate tubular bodies coupled directly together.

3. The drilling assembly of claim 1, wherein the first tubular body of the expandable reamer and the second tubular body of the expandable stabilizer comprise different regions of a unitary tool body.

4. The drilling assembly of claim 3, wherein the bearing pads are located a distance in a range extending from about 10 feet to about 15 feet above the blades.

5. The drilling assembly of claim 3, wherein the bearing pads are located a distance in a range extending from about 15 feet to about 25 feet above the blades.

6. The drilling assembly of claim 1, wherein the first longitudinal axis of the expandable reamer is co-axial with the second longitudinal axis of the expandable stabilizer.

7. A drilling assembly for drilling a subterranean wellbore, comprising:

an expandable reamer comprising a first tubular body having a first longitudinal axis and a first drilling fluid flow path extending therethrough, a plurality of blades carried by the first tubular body, and a cutting structure carried by at least one blade of the plurality of blades, wherein the at least one blade is outwardly movable from a retracted position to an extended position with respect to the first longitudinal axis, the expandable reamer further comprising a first actuation device for moving the at least one blade from the retracted position to the extended position and a first electrical device configured to receive a first electronic signal and actuate the first actuation device responsive to the first electronic signal, wherein the first electrical device comprises a first processor; and an expandable stabilizer axially spaced from the expandable reamer and comprising a second tubular body having a second longitudinal axis and a second drilling fluid flow path extending therethrough, a plurality of bearing pads carried by the second tubular body, wherein at least one bearing pad of the plurality of bearing pads is outwardly movable from a retracted position to an extended position with respect to the second longitudinal axis, the expandable stabilizer further comprising a second actuation device for moving the at least one bearing pad from the retracted position to the extended position and a second electrical device configured to receive a second electronic signal and actuate the second actuation device responsive to the second electronic signal, wherein the second electrical device comprises a second processor.

8. The drilling assembly of claim 7, further comprising a bi-directional communication pulse module (BCPM) configured to transmit the first electronic signal to the first electrical device of the expandable reamer.

9. The drilling assembly of claim 8, wherein the BCPM is configured to transmit the second electronic signal to the second electrical device of the expandable stabilizer.

10. The drilling assembly of claim 7, further comprising a sensor device configured to indicate a diameter of the wellbore proximate the expandable stabilizer, the sensor device comprising an electronic device configured to transmit the second electronic signal to the second electrical device of the expandable stabilizer when the diameter of the wellbore corresponds to a predetermined diameter.

11. The drilling assembly of claim 7, further comprising at least one section of electrically communicative drill pipe located in the drilling assembly, the at least one section of electrically communicative drill pipe providing an electrical interconnection between two components of the drilling assembly coupled directly to opposing ends of the at least one section of electrically communicative drill pipe, wherein the first electronic signal is transmitted through the at least one section of electrically communicative drill pipe to the first electrical device of the expandable reamer.

12. The drilling assembly of claim 11, wherein the second electronic signal is transmitted through the at least one section of electrically communicative drill pipe to the second electrical device of the expandable stabilizer.

13. The drilling assembly of claim 7, further comprising a revolutions per minute (RPM) recognition device configured to transmit the second electronic signal to the second electrical device of the expandable stabilizer responsive to detection of a predetermined series of operating revolution-per-minute intervals.

14. The drilling assembly of claim 7, wherein the first actuation device does not comprise a ball trap mechanism.

15. The drilling assembly of claim 14, wherein the first actuation device comprises at least one of a downhole pump and a downhole turbine configured to pressurize hydraulic fluid enclosed and sealed within the first tubular body of the expandable reamer.

16. The drilling assembly of claim 7, wherein the second actuation device does not comprise a ball trap mechanism.

17. The drilling assembly of claim 16, wherein the second actuation device comprises at least one of a downhole pump and a downhole turbine configured to pressurize hydraulic fluid enclosed and sealed within the second tubular body of the expandable stabilizer.

18. A method of forming a drilling assembly for drilling a subterranean wellbore, comprising:

coupling an expandable stabilizer to an expandable reamer, the expandable reamer comprising a first tubular body having a first longitudinal axis and a first drilling fluid flow path extending therethrough, a plurality of blades carried by the first tubular body, and a cutting structure carried by at least one blade of the plurality of blades, wherein the at least one blade is outwardly movable from a retracted position to an extended position with respect to the first longitudinal axis for reaming a section of the wellbore responsive to a first electronic signal received by a first electrical device located in the first tubular body, the first electrical device comprising a first processor, the expandable stabilizer comprising a second tubular body having a second longitudinal axis and a second drilling fluid flow path extending therethrough, a plurality of bearing pads carried by the second tubular body, wherein at least one bearing pad of the plurality of bearing pads is outwardly movable from a retracted position to an extended position with respect to the second longitudinal axis responsive to a second electronic signal received by a second electrical device located in the second tubular body, the second electrical device comprising a second processor; and axially locating the expandable stabilizer a distance of about 25 feet or less above the blades of the expandable reamer.

19. The method of claim 18, wherein coupling the expandable stabilizer to the expandable reamer comprises forming the expandable stabilizer and the expandable reamer to comprise different regions of a unitary tubular body.

20. The method of claim 18, further comprising configuring the at least one outwardly movable bearing pad to move from the retracted position to the extended position at least substantially automatically after the expandable reamer has reamed a section of the wellbore having a length equal to or greater than the distance the expandable stabilizer is axially located above the blades of the expandable reamer.

* * * * *